US005586665A

United States Patent [19]

Brousseau

[11] Patent Number: 5,586,665

[45] Date of Patent: Dec. 24, 1996

[54] GRAVITY FED BOTTLE DISPENSING AND DISPLAY RACK

[75] Inventor: Claude Brousseau, Iles Perreault, Canada

[73] Assignee: Etalex Inc., Montreal, Canada

[21] Appl. No.: 396,712

[22] Filed: Mar. 1, 1995

[51] Int. Cl.[6] ..... A47F 1/04; A47F 7/28

[52] U.S. Cl. ..... 211/59.2; 211/74; 211/94; 211/162; 211/175; 312/45; 312/72

[58] Field of Search ..... 211/59.2, 74, 94, 211/94.5, 162, 175; 248/311.2, 312; 312/334.23, 128, 184, 42, 45, 72, 73

[56] References Cited

U.S. PATENT DOCUMENTS

| | | | |
|---|---|---|---|
| 1,619,999 | 3/1927 | Wright | 312/45 X |
| 2,119,700 | 6/1938 | Burgess | 312/45 X |
| 2,620,691 | 12/1952 | Gould | 211/74 X |
| 3,008,783 | 11/1961 | Roehl | 312/45 |
| 3,501,016 | 3/1970 | Eaton | 211/74 X |
| 4,310,097 | 1/1982 | Merl | 211/74 X |
| 4,367,818 | 1/1983 | Suttles | 211/74 X |
| 4,474,297 | 10/1984 | Zucker | 312/45 X |
| 4,562,927 | 1/1986 | Frederickson | 211/59.2 |

FOREIGN PATENT DOCUMENTS

| | | | |
|---|---|---|---|
| 259169 | 2/1965 | Australia | 211/74 |
| WO94/10885 | 5/1994 | WIPO | 211/74 |

*Primary Examiner*—Alvin C. Chin-Shue
*Assistant Examiner*—Brian J. Hamilla

[57] ABSTRACT

A gravity fed bottle dispensing and display rack is comprised of a support frame having front and rear transverse horizontal rigid members. A straight bottle support channel is interconnected between the transverse horizontal rigid members and inclined downwardly from a rear end thereof to a front open end. The support channel has a longitudinal slot defined longitudinally thereof in a lower end and extends between opposed support flanges. The support channel has a horizontally extending dispensing front section adjacent the front open end. Attachment clamps are provided for securing the support channel to the front and rear transverse horizontal rigid members. An arresting element is provided to abuttingly engage a forwardmost bottle suspended by a neck thereof by the channel at the dispensing front section to arrest the forwardmost bottle at the front open end of the support channel. An abutment element is provided in the dispensing front section of the channel at a predetermined location to releasably engage an upper end of the forwardmost bottle.

9 Claims, 2 Drawing Sheets

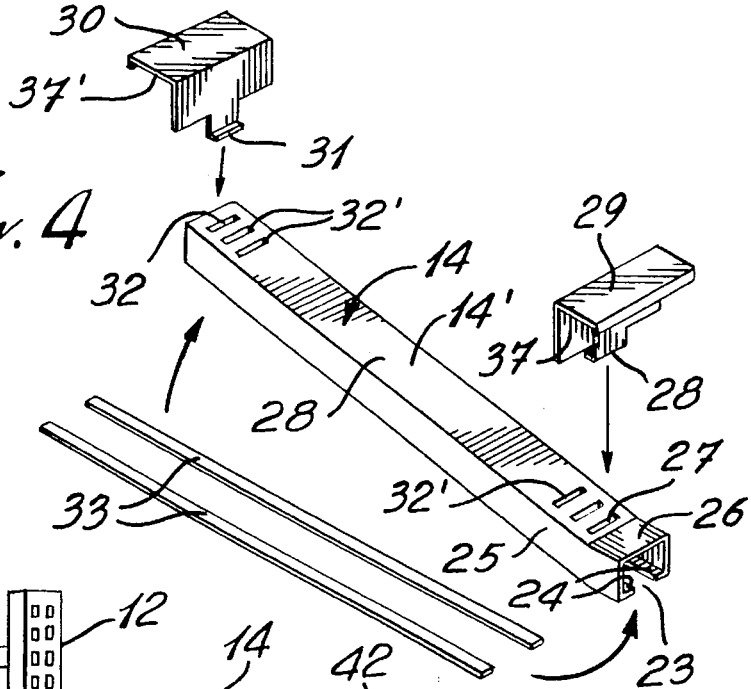
Fig. 4
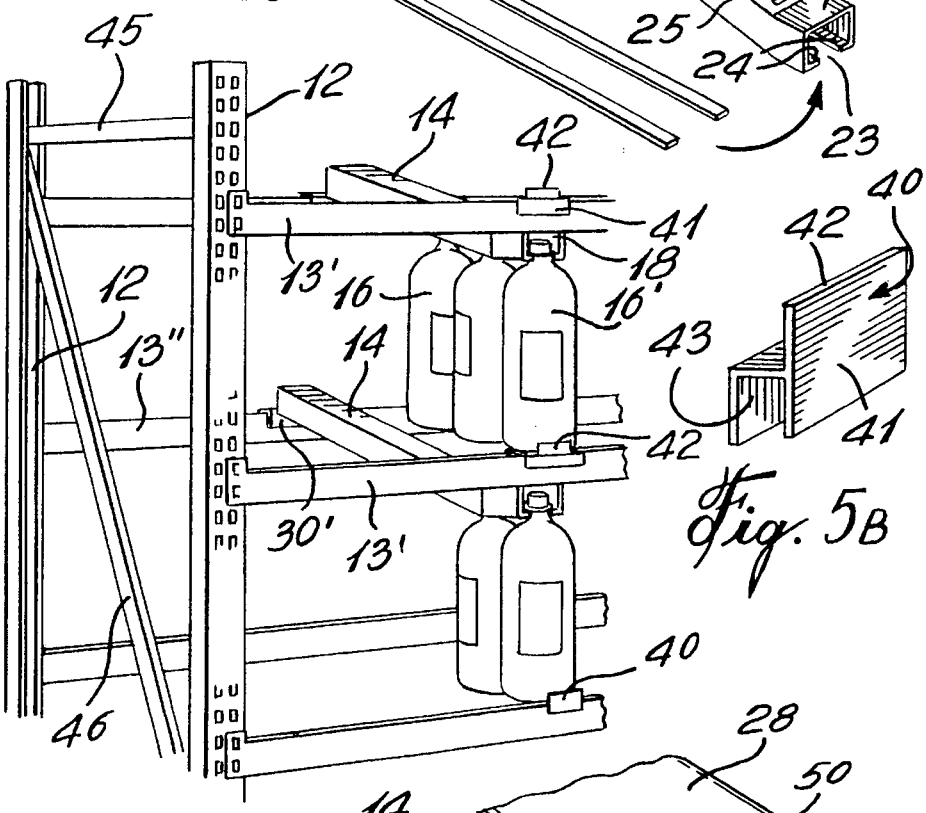
Fig. 5B
Fig. 5A
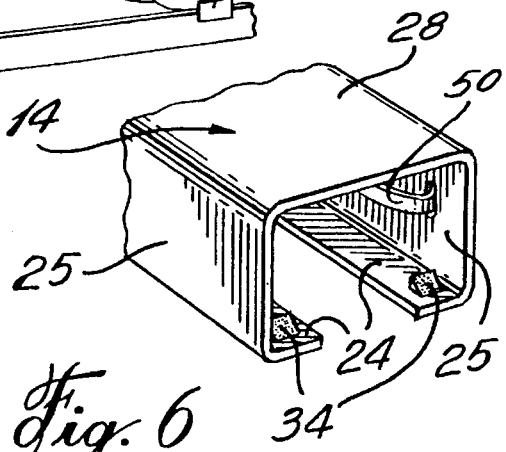
Fig. 6

GRAVITY FED BOTTLE DISPENSING AND DISPLAY RACK

TECHNICAL FIELD

The present invention relates to a gravity bottle dispensing and display rack wherein the rack and the bottle support channels are displaceably connected to the frame to accommodate bottles of different widths and lengths, and to prevent prolonged storage of bottles within the display rack.

BACKGROUND ART

Gravity fed bottle dispensing and display racks are well known in the art and examples of such can be found in U.S. Pat. Nos. 1,973,854; 4,318,485 and 4,367,818. These prior art patents illustrate racks wherein bottles are suspended by a collar formed below the bottle cap, or by the bottle cap itself, and gravity fed, due to the inclined securement of the support channels, to a front dispensing end of the rack. All of these patents disclose systems wherein the channels are fixed at predetermined locations in the rack, and wherein the channels are equidistantly spaced both in the vertical and horizontal planes. Accordingly, the racks can accommodate bottles of specific sizes only and longer bottles cannot be used, nor bottles of larger width or circumference. A still further disadvantage of such racks is that, because it is common to load the racks from the front end of the channels, often a bottle will be pushed back in the channel and remain in the rack for a very long period of time thereby causing the liquid within the bottle, usually a soft drink, to go bad.

A still further disadvantage of such racks is that the frame is usually welded or otherwise permanently secured in an assembled condition, therefore making it awkward to transport or to relocate, as it cannot be assembled on site. Another disadvantage of such racks is that they have a complex structure and are difficult to construct and assemble.

SUMMARY OF INVENTION

It is a feature of the present invention to provide a gravity fed bottle dispensing and display rack which substantially overcomes the above disadvantages of the prior art and which provides further advantages.

According to the above feature, from a broad aspect, the present invention provides a gravity fed bottle dispensing and display rack which comprises a support frame having front and rear transverse horizontal rigid members. A straight bottle support channel is interconnected between the transverse horizontal rigid members and inclined downwardly from a rear end thereof to a front open end. The bottle support channel has a longitudinal slot defined longitudinally thereof in a lower end and which extends between opposed support flanges. The support channel has a dispensing front section adjacent the front open end. Attachment means is provided for securing the support channel to the front and rear transverse horizontal rigid members. Arresting means is provided to abuttingly engage a forwardmost bottle suspended by a neck thereof by the channel at the dispensing front section to arrest the forwardmost bottle at the front open end of the support channel. An abutment element is provided in the dispensing front section of the channel at a predetermined location to releasably engage an upper end of the forwardmost bottle.

BRIEF DESCRIPTION OF DRAWINGS

A preferred embodiment of the present invention will now be described with reference to the accompanying drawings in which:

FIG. 4 is an exploded view illustrating the construction of the support channel and its support brackets;

FIG. 5A is a fragmented perspective view showing a modification of the manner in which the support channel is secured to the support frame;

FIG. 5B is a perspective view of a modified arresting tab; axed

FIG. 6 is an enlarged view of the open end of the support channel illustrating the location of the abutment tabs provided in the support flanges at the front open end of the support channels.

DESCRIPTION OF PREFERRED EMBODIMENTS

Figure 1:
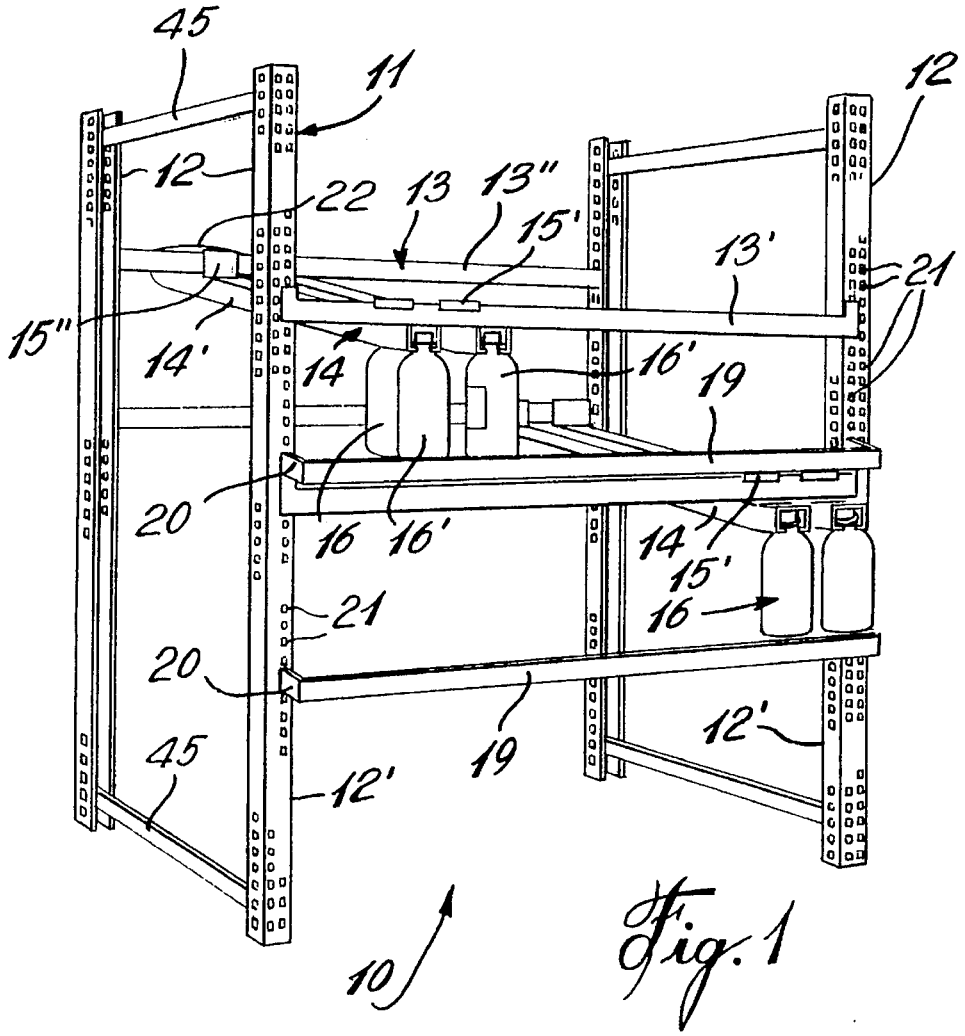
FIG. 1 is a perspective view of the gravity fed bottle dispensing and display rack of the present invention and showing bottles retained by the support channels.

Referring now to the drawings, and more specifically to FIG. 1, there is shown generally at 10 the gravity fed bottle dispensing and display rack of the present invention. The rack comprises a support frame 11 formed of corner posts 12 interconnected by front and rear transverse horizontal rigid members 13 and side members 45. One or more straight bottle support channels 14 are interconnected between the front and rear horizontal members 13' and 13", respectively, by attachment brackets 15' and 15". A plurality of bottles 16 is retained by their necks 17 in the support channels 14. As herein shown, the bottle support channels are inclined downwardly towards a front open end 18 thereof whereby the bottles 16 are fed by gravity. A forwardmost one of the bottles, namely bottle 16', is arrested in its forwardmost position by an arresting means herein provided by an elongated arresting bar 19 connected at opposed ends 20 thereof to connecting slots 21 provided in the front wall 12' of the corner posts 12.

Figure 2:
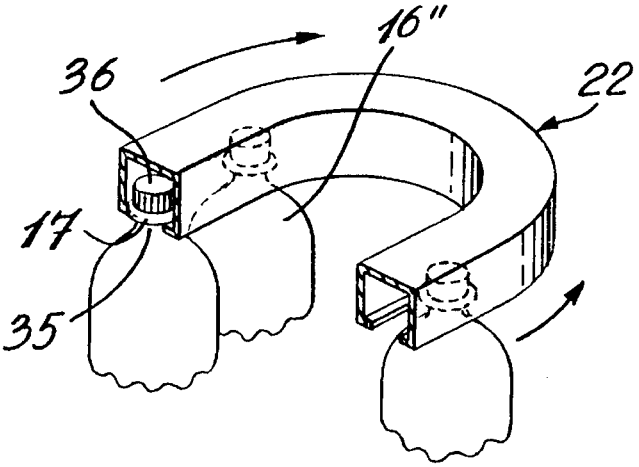
FIG. 2 is a simplified perspective view showing the construction of the rear arcuate channel section which interconnects straight bottle support channels of a U-shaped channel member.
Figure 3:
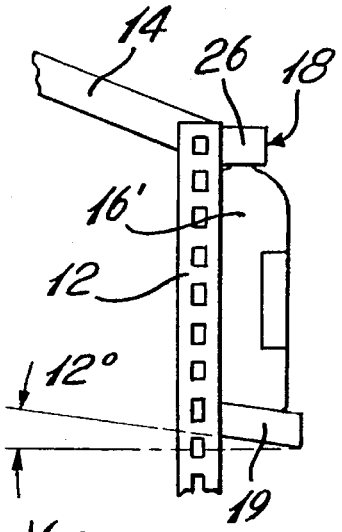
FIG. 3 is a side view showing the position of a forwardmost bottle held by the support channel and the arresting bar.

Referring now additionally to FIGS. 2 to 4, there will be described the construction of the bottle support channels 14. As shown in FIGS. 1 and 2, the support channel is formed as a two-section channel constituted by a pair of straight bottle support channel members 14' which are held in side-by-side parallel relationship and interconnected at a rear end by a curved channel section 22, as more clearly shown in FIG. 2. The rear arcuate channel section 22 may be welded or preferably removably connected to a rear end of the straight channel members 14' whereby single straight channels as well as U-shaped channels may be removably connected in the frame. As shown in FIG. 5A, the channel member may also be constituted by single straight channel members 14' interconnected between the horizontal members 13, as shown in FIG. 5A.

Each of the channel members 14' is provided with a longitudinal slot 23 formed in a lower end thereof and extends between opposed support flanges 24 which are formed by an inwardly turned end section of the side walls 25 of the channel member 14. The channel member is also formed with an angled dispensing front section 26. A connecting slot 27 is provided in the top wall 28 of the channel member 14 to receive a connecting lip 28 of a front support bracket 29. A rear support bracket 30 is secured to the rear end of the channel in the same manner whereby its connecting lip 31 is received in the connecting slot 32 provided in the top wall 28 of the channel member 14 adjacent the rear end thereof. Additional slots 27' and 32' are also provided to adapt the channels to narrow frames. A flexible strip 33 having a low friction surface thereon may also be clamped to the support flanges 24 whereby the bottles 16 can slide freely thereon with very little resistance.

Referring again to FIG. 1, it can be seen that the front horizontal rigid member 13' is secured in a horizontal plane which is lower than the rear horizontal rigid member 13". This is so in order that the channel member 14 be sloped downwardly from the rear end thereof to the front dispensing section 26 which lies substantially in a horizontal plane, as shown in FIG. 3. As also shown in FIG. 3, the channel member is sloped at an angle of about 1220 whereby the bottles which are positioned within the channel members are fed forwardly towards the dispensing front section 26 by gravity. However, depending on the weight and types of bottles used, different angulations may be preferred. In order to load the channel members with bottles 16, the bottles are inserted from the front open end 18 of one of the straight channel sections 14' until no further bottle can be added in the channel. As shown in FIG. 2, when the bottles are pushed in one of the straight channel sections 14' of a U-shaped channel member, they will move into the other straight channel section through the rear arcuate channel section 22. This arrangement provides for the rear bottle, herein bottle 16", to move into the adjacent channel so that the rear bottle 16" does not remain suspended within the channel member for a long period of time. It is important to recycle the bottles within the rack, and this is achieved by the rear arcuate channel section. The person loading these channel members would be instructed to load only one of the channel members so that the rear bottles are recycled quickly through the other straight channel member.

As shown in FIG. 6, the front open end 18 of the channel can also be provided with an arresting means, herein in the form of abutment tab 34, punched out of the flanges 24 to extend within the channel to abut against the collar 35 or cap 36 of the forwardmost bottle 16', as shown in FIG. 3.

It is pointed out that, because the support brackets are connected to the channel members by connecting lips 28, 31 engaged within slots 27, 32 formed in the top of the channels, this provides a hinge connection whereby the channel members may be hinged at a steeper angle depending on the nature of the bottles to be supported thereby. The front and rear support brackets 29 and 30 also have a channel section 37 and 37' respectively whereby they are slidingly engaged on the horizontal rigid members 13' and 13" respectively, so that the channel member 14 may be displaced laterally within the support rack. This is particularly useful when the channels are provided as straight sections, as shown in FIG. 5A, so that different numbers of channel members may be provided in each horizontal stack to hold bottles of different shapes. With the rack of the present invention it is also seen that the spacing between the rows of bottle support channels may vary to support bottles of different length. This provides for less loss of space within the rack and also provides the user with a means to structure a rack having more visual appeal to his customers. He can stack small and larger bottles in the same rack and in close spacing.

With the embodiment as shown in FIG. 5A, it can be seen that the rear support bracket 30' is connected under the straight channel member 14' and the horizontal rigid members 13' and 13" are supported in substantially the same plane. The angulation of the channel member is provided simply by the fact that the rear bracket is located under the channel member and the front one over the channel member. As herein shown, the arresting means is a friction tab 40 (see FIG. 5B) formed of plastics material or any other suitable material, such as a short length of extruded aluminum material, and defines a front wall 41 on which an identification sticker (not shown) can be applied to identify the bottles thereabove. The front wall has an extension lip 42 on which the forwardmost bottle 16' abuts (see FIG. 5A) to prevent the bottle from forward movement. It is also possible to use other means than the lips 42 to arrest the forwardmost bottle. For example, a leaf spring 50 (see FIG. 6) may be secured to the sidewalls or top wall of the channel adjacent the open front end to frictionally engage the top end of the bottle. By pulling the bottle the spring would bend to cause the bottle to be removed. It also defines a channel portion 43 which is frictionally retained on the front horizontal rigid member 13' and may be displaced therealong to align same in a vertical plane with the front open end 18 of the channel member 14. As herein shown, reinforcing transverse members 45 are also removably securable as the members 13,13'. Diagonal braces 46 may also be connected to the corner posts 12 to provide added rigidity to the structure and these may also be soldered.

It is within the ambit of the present invention to cover any obvious modifications of the preferred embodiment described herein, provided such modifications fall within the scope of the appended claims. For example, the channel members may be formed from wire members or metal or plastic channel members. Similarly, the support brackets may be formed of plastics material as well as the arresting member 19 or 40. It is also conceivable that the entire rack could be formed from structural plastic members, although in this embodiment they are formed by steel members.

I claim:

1. A gravity fed bottle dispensing and display rack comprising a support frame having front and rear transverse horizontal rigid members, a straight bottle support channel interconnected between said transverse horizontal rigid members and oriented downwardly from a rear end thereof to a front open end, said support channel having a longitudinal slot defined longitudinally thereof in a lower end and extends between opposed support flanges, said support channel having a dispensing front section adjacent said front open end, said dispensing front section of said support channel extending in a substantially horizontal plane, with the remaining section being inclined upwardly towards, said rear end, attachment means for securing said support channel to said front and rear transverse horizontal rigid members, said attachment means being clampingly and displaceably connected to said front and rear transverse horizontal rigid members to position said support channel at a desired lateral spacing in said support frame to accommodate bottles of different diameters, said attachment means comprises a rear clamp secured to a rear end of said bottle support channel and said rear transverse horizontal rigid member for maintaining said rear end of said support channel elevated from said dispensing front section, and a front clamp to said front section of said bottle support channel and secured said front transverse horizontal rigid member, arresting means adapted to abuttingly engage a forwardmost bottle suspended by a neck thereof by said support channel at said dispensing front section to arrest said forwardmost bottle at said front open end of said support channel, and abutment means secured inwardly of said support channel in said dispensing front section at a predetermined location to releasably engage an upper end of said forwardmost bottle.

2. A rack as claimed in claim 1 wherein said support channel is an elongated U-shaped channel formed by a pair of said straight bottle support channels held in a side-by-side parallel relationship and interconnected at a rear end by a curved channel section, so that when a plurality of bottles are retained by their necks in one of said pair of straight bottle support channels and further bottles are introduced through said front open end thereof, the rearward most ones of said plurality of bottles will be displaced into said other of said pair of straight bottle support channels through said curved channel section.

3. A rack as claimed in claim 1 wherein said abutment means is disposed on a top surface of one or both of said support flanges at a predetermined location in said front open end to abuttingly engage an upper end of said forwardmost bottle.

4. A rack as claimed in claim 1 wherein said front and rear transverse horizontal members are flat rectangular bars, said rear and front clamps being slidingly engaged with a respective one of said rectangular bars for translational displacement of said bottle support channel.

5. A rack as claimed in claim 4 wherein said front and rear transverse horizontal members are detachably secured to vertical corner posts of said support frame, said horizontal members lying in a common horizontal plane.

6. A rack as claimed in claim 4 wherein said front and rear transverse horizontal members are detachably secured to vertical corner posts of said support frame, said rear horizontal member being disposed elevated from said front horizontal member.

7. A rack as claimed in claim 6 wherein said front and rear transverse horizontal members are detachably secured to vertical corner posts of said support frame, said corner posts having a plurality of vertically aligned connecting means for receiving a complementary connector of said front or rear transverse horizontal rigid members whereby two or more horizontal rows of said channels may be secured to said frame and at predetermined spacings to accommodate bottles of different lengths.

8. A rack as claimed in claim 1 wherein said arresting means is an arresting bar secured to said support frame and protruding forwardly of said frame, said dispensing front section of said support channel having at least a section thereof protruding forwardly of said frame.

9. A rack as claimed in claim 1 wherein said arresting means is a friction tab displaceably engageable with said front transverse horizontal rigid member and vertically aligned with said front open end of said support channel.

* * * * *